US006536059B2

(12) United States Patent
McClain et al.

(10) Patent No.: US 6,536,059 B2
(45) Date of Patent: Mar. 25, 2003

(54) PUMPLESS CARBON DIOXIDE DRY CLEANING SYSTEM

(75) Inventors: James B. McClain, Raleigh, NC (US); Michael E. Cole, Raleigh, NC (US)

(73) Assignee: MiCell Technologies, Inc., Raleigh, NC (US)

( * ) Notice: Subject to any disclaimer, the term of this patent is extended or adjusted under 35 U.S.C. 154(b) by 80 days.

(21) Appl. No.: 09/760,346

(22) Filed: Jan. 12, 2001

(65) Prior Publication Data

US 2002/0189026 A1 Dec. 19, 2002

(51) Int. Cl.[7] ..... D06F 39/08

(52) U.S. Cl. ..... 8/158; 8/159; 68/18 C; 68/207

(58) Field of Search ..... 8/158, 159, 142; 68/18 R, 18 C, 207; 134/10, 12, 107

(56) References Cited

U.S. PATENT DOCUMENTS

| | | | | |
|---|---|---|---|---|
| 1,934,833 A | * | 11/1933 | Thompson | |
| 3,893,625 A | * | 7/1975 | Wiggins | |
| 4,613,412 A | * | 9/1986 | MacDermid | |
| 4,886,090 A | * | 12/1989 | Hays | |
| 5,267,455 A | | 12/1993 | Dewees et al. | 68/5 |
| 5,370,742 A | | 12/1994 | Mitchell et al. | 134/10 |
| 5,412,958 A | | 5/1995 | Iliff et al. | 68/5 C |
| 5,651,276 A | * | 7/1997 | Purer et al. | |
| 5,669,251 A | * | 9/1997 | Townsend et al. | |
| 5,850,747 A | | 12/1998 | Roberts et al. | 68/15 |
| 5,904,737 A | * | 5/1999 | Preston et al. | |
| 5,937,675 A | | 8/1999 | Stucker | 68/18 R |
| 5,943,721 A | | 8/1999 | Lerette et al. | 8/158 |
| 5,970,554 A | | 10/1999 | Shore et al. | 8/158 |
| 6,082,150 A | | 7/2000 | Stucker | 68/18 R |
| 6,098,430 A | | 8/2000 | McClain et al. | 68/18 R |

FOREIGN PATENT DOCUMENTS

| | | | |
|---|---|---|---|
| EP | 0 828 020 A2 | 3/1998 | D06F/43/00 |
| WO | WO 81/01246 | 5/1981 | B01D/21/26 |
| WO | WO 97/33031 | 9/1997 | D06F/21/03 |
| WO | WO 99/13148 | 3/1999 | D06F/43/08 |
| WO | WO 00/53839 | 9/2000 | |

OTHER PUBLICATIONS

Xu, Nanping, et al.; *High pressure Vapor Liquid Equilibria at 293 K for Systems Containing Nitrogen, Methane and Carbon Dioxide, Fluid Phase Equilibria,* vol. 71, pp. 175–186 (1992)).

* cited by examiner

*Primary Examiner*—Frankie L. Stinson
(74) *Attorney, Agent, or Firm*—Myers Bigel Sibley & Sajovec

(57) ABSTRACT

The present invention provides a method for the pumpless transfer of liquid carbon dioxide cleaning medium in a carbon dioxide dry cleaning apparatus having a wash vessel, a working vessel, a vapor vessel, and a compressor. The apparatus is preferably overpressurized with an overpressurization gas such as air. The method comprises (a) storing liquid carbon dioxide dry cleaning medium in the working vessel; (b) storing a vapor comprising air and carbon dioxide as a gas under pressure in the vapor vessel; (c) transferring a portion of the vapor from the vapor vessel to the wash vessel, by at least partially equilibrating the pressure between the vapor vessel and the wash vessel, with the wash vessel remaining at a pressure less then that of the working vessel; then (d) transferring at least a portion of the liquid carbon dioxide cleaning medium from the working vessel to the wash vessel by the force of a pressure differential therebetween; (e) washing articles to be cleaned in the wash vessel while concurrently (f) circulating at least a portion of the liquid dry cleaning medium back and forth between the wash vessel to the working vessel.

20 Claims, 3 Drawing Sheets

Cleaning Apparatus

Cleaning Apparatus

Alternate Methods for Pumpless Transfer of Cleaning Medium

PUMPLESS CARBON DIOXIDE DRY CLEANING SYSTEM

FIELD OF THE INVENTION

The present invention concerns methods for articles such as garments, fabrics and the like in a liquid carbon dioxide cleaning medium.

BACKGROUND OF THE INVENTION

Organic solvents such as perchlorethylene and other low-pressure liquid solvents have long been used in cleaning system such as dry cleaning systems. Recently, however, there are growing concerns that these solvents may harm the environment and pose occupational safety hazards. These concerns have led to an extensive search for alternate solvents that are less hazardous, and systems for applying such solvents. Examples are those systems described in U.S. Pat. No. 6,098,430 to McClain et al., and U.S. Pat. No. 5,943,721 to Lerette et al. Other systems are described in PCT Publication WO 99/13148 to Shore et al. and PCT Publication WO 97/33031 to Taricco.

U.S. Pat. No. 5,370,742 to Mitchell et al. (Clorox) describes a liquid/supercritical cleaning system in which a first fluid is removed from contact with the substrate to be cleaned with a second fluid, where the first fluid is a densified gas and the second fluid is a compressed gas.

U.S. Pat. No. 5,904,737 to Preston et al. (MVE, Inc.) describes a carbon dioxide dry cleaning system featuring a pair of liquid carbon dioxide storage tanks, in which the pair of storage tanks are selectively pressurized with a compressor to cause the liquid carbon dioxide to flow through cleaning nozzles in a wash vessel to agitate objects being cleaned therein. However, Preston uses a pump to circulate wash medium to achieve jet aggitation (See column 8, line 57).

PCT Application WO 00/53839 to Carr (Sail Star Ltd) describes a dry cleaning process using rotating basket agitation in which the cleaning chamber is filled by creating a pressure differential and causing carbon dioxide to flow in response to the pressure differential.

PCT Application WO 81/01246 to Witzenburg (Caterpillar Tractor Co.) describes a pumpless flow system for corrosive liquids in which liquid is transported by pressure differential without the need for mechanical pumps.

SUMMARY OF THE INVENTION

The present invention provides a method for the pumpless transfer of liquid carbon dioxide cleaning medium in a carbon dioxide dry cleaning apparatus having a wash vessel, a working vessel, a vapor vessel, and a compressor. The apparatus is preferably overpressurized with about 10, 30 or 50 to about 130, 150 or 180 psig of of an overpressurization gas such as air. The method comprises steps of:

(a) storing liquid carbon dioxide dry cleaning medium in the working vessel;

(b) storing a vapor comprising air and carbon dioxide as a gas under pressure in the vapor vessel;

(c) transferring a portion of the vapor from the vapor vessel to the wash vessel, by at least partially equilibrating the pressure between the vapor vessel and the wash vessel, with the wash vessel remaining at a pressure less then that of the working vessel; then (d) transferring at least a portion of the liquid carbon dioxide cleaning medium from the working vessel to the wash vessel by the force of a pressure differential therebetween;

(e) washing articles to be cleaned in the wash vessel while concurrently (f) circulating at least a portion of the liquid dry cleaning medium (i) from the wash vessel to the working vessel by compressing vapor from the working vessel into the wash vessel with the compressor, and then (ii) from the working vessel back to the wash vessel by compressing vapor from the wash vessel into the working vessel with the compressor. Preferably the apparatus further includes a filter, and the aforesaid circulating is carried out at least in part through the filter.

In one embodiment, step (d) of transferring at least a portion of the liquid carbon dioxide cleaning medium is carried out by providing a difference in elevation between the working vessel and the wash vessel.

In another embodiment, step (d) of transferring at least a portion of the liquid carbon dioxide cleaning medium is carried out by: (i) transferring liquid carbon dioxide cleaning medium from the working vessel to the wash vessel by the force of the pressure differential between the working vessel and the wash vessel (referred to as "PDPV" below); and then (ii) transferring liquid carbon dioxide cleaning medium from the working vessel to the wash vessel by compressing vapor into the working vessel with the compressor to create a pressure differential between the wash working vessel and the wash vessel, with the cleaning medium transferring in response to the pressure differential. Transferring step (ii) may be carried out by compressing vapor from the vapor vessel into the working vessel, or may be carried out by compressing vapor from the wash vessel into the working vessel.

In another embodiment, step (d) of transferring at least a portion of the liquid carbon dioxide cleaning medium is carried out by: (i) compressing vapor from the vapor vessel into the wash vessel with the compressor; and then (ii) transferring liquid carbon dioxide cleaning medium from the working vessel to the wash vessel by compressing vapor into the working vessel with the compressor to create a pressure differential between the wash working vessel and the wash vessel, with the cleaning medium transferring in response to the pressure differential. The transferring step (ii) may be carried out by compressing vapor from the vapor vessel into the working vessel, or may be carried out by compressing vapor from the wash vessel into the working vessel.

In one embodiment of the invention, the transferring step (c) is preceded by evacuating at least a portion of the air from the wash vessel In another embodiment of the invention, the transferring step (c) is preceded by (directly or indirectly) adding carbon dioxide to the wash vessel (e.g., to make up for carbon dioxide lost during a previous cycle).

In another embodiment of the invention, the washing step (e) is followed by the steps of: (f) transferring the liquid carbon dioxide cleaning medium from the wash vessel to the working vessel by the force of a pressure differential created with the compressor; and then (g) transferring the vapor from the wash vessel to the vapor vessel with the compressor. When the transferring step (c) is completed, there is typically a final venting of carbon dioxide, the loss of which may be made up prior to the next cycle as noted above.

As noted above, the apparatus preferably further comprises a filter. In such a case, the method preferably further comprises the steps of: filtering the liquid carbon dioxide cleaning medium through the filter between washing steps and independently of the wash vessel by the force of a pressure differential created with the compressor. The filtering step may be carried out by transferring the liquid carbon dioxide cleaning medium between the working vessel and the vapor vessel. More particularly, the filtering step may be carried out by (i) transferring the liquid carbon dioxide cleaning medium from the working vessel to the vapor vessel through the filter by the force of a pressure differential created with the compressor, and then (ii) draining the liquid carbon dioxide cleaning medium from the vapor vessel back to the working vessel. In the alternative, the filtering step may be carried out by (i) transferring the liquid carbon dioxide cleaning medium from the working vessel to the vapor vessel through the filter by the force of a pressure differential created with the compressor, and then (ii) transferring the liquid carbon dioxide cleaning medium from the vapor vessel back to the working vessel by the force of a pressure differential created with the compressor.

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Figure 1:
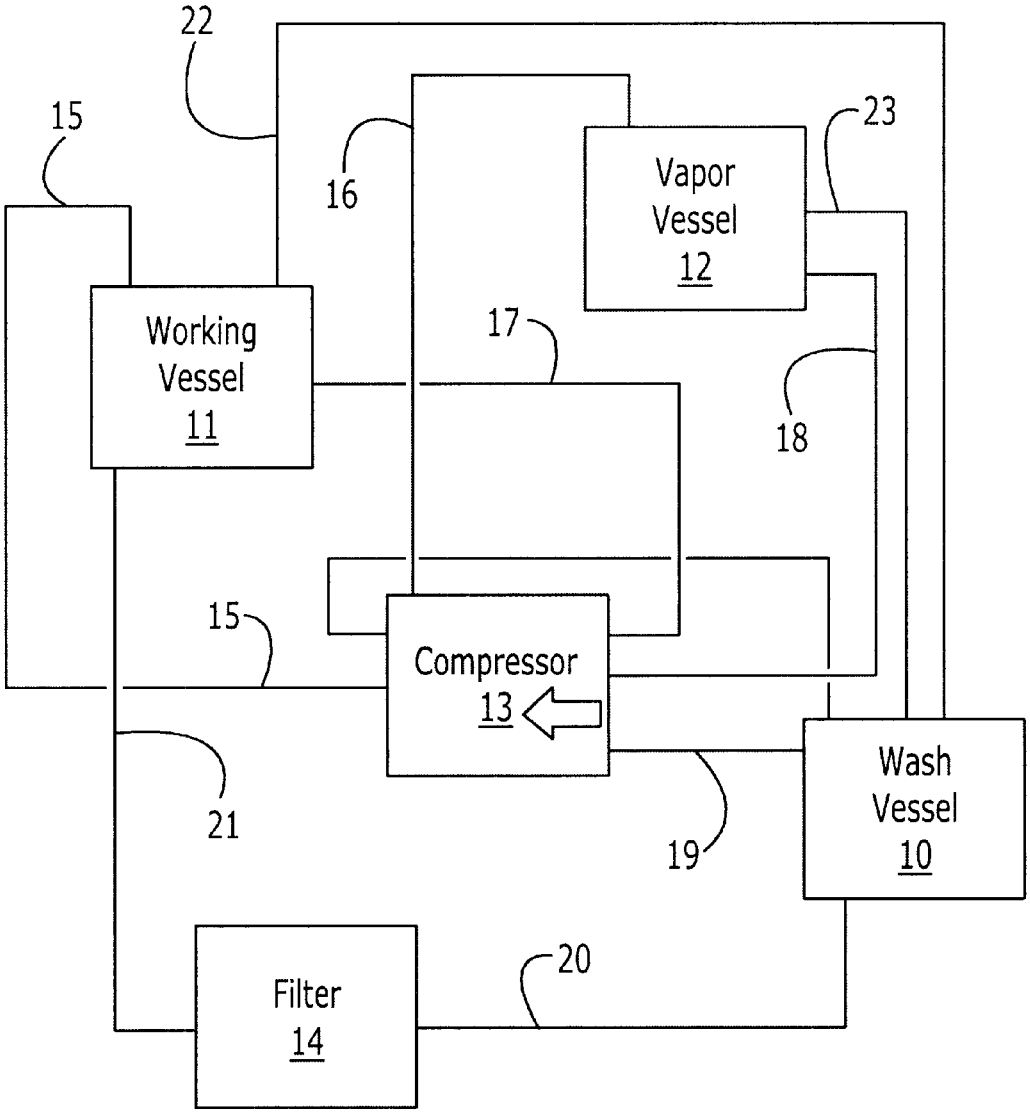
FIG. 1 illustrates a dry cleaning apparatus that may be used to carry out the present invention.

The present invention may be carried out in any suitable carbon dioxide dry cleaning apparatus. One example of a suitable apparatus is that described in D. Brainard et al., *Methods and Apparatus for Conserving Vapor and Collecting Liquid Carbon Dioxide for Carbon Dioxide Dry Cleaning,* U.S. patent application Ser. No. 09/404,957, Filed Sep. 24, 1999 (Applicants Specifically intend that the disclosure of this and all other U.S. Patents and Patent Applications cited herein be incorporated herein by reference). In general, as illustrated in FIG. 1, such an apparatus comprises a wash vessel 10 for washing articles to be cleaned, a working vessel 11 for storing the liquid cleaning composition, a vapor vessel 12 for saving and storing vapor between wash cycles (obviating the need for condensing gas that forms a portion of the liquid cleaning composition), a compressor 13, and a filter 14 for filtering the liquid cleaning composition to remove soil, particles and the like that have been removed from the articles to be cleaned in the wash vessel during the wash cycle. Preferably, the filter unit 14 contains piping and valving such that it allows filtration as fluids are moving in both directions. Associated piping may include line 15 exiting compressor 13 and leading to working vessel 11, line 16 exiting the compressor and leading to vapor vessel 12, line 17 exiting the working vessel and leading to the compressor, line 18 exiting the vapor vessel and leading to the compressor, line 19 exiting the wash vessel and leading to the compressor, line 20 exiting the wash vessel and leading to the filter, line 21 exiting the filter and leading to the working vessel, line 22 exiting the working vessel and leading to the wash vessel, line 23 exiting the vapor vessel and leading to the wash vessel, and line 24 exiting the compressor and leading to the wash vessel. Valves, solenoids and other control lines are not illustrated for clarity, but may be implemented in accordance with standard techniques known in the art.

Figure 2:
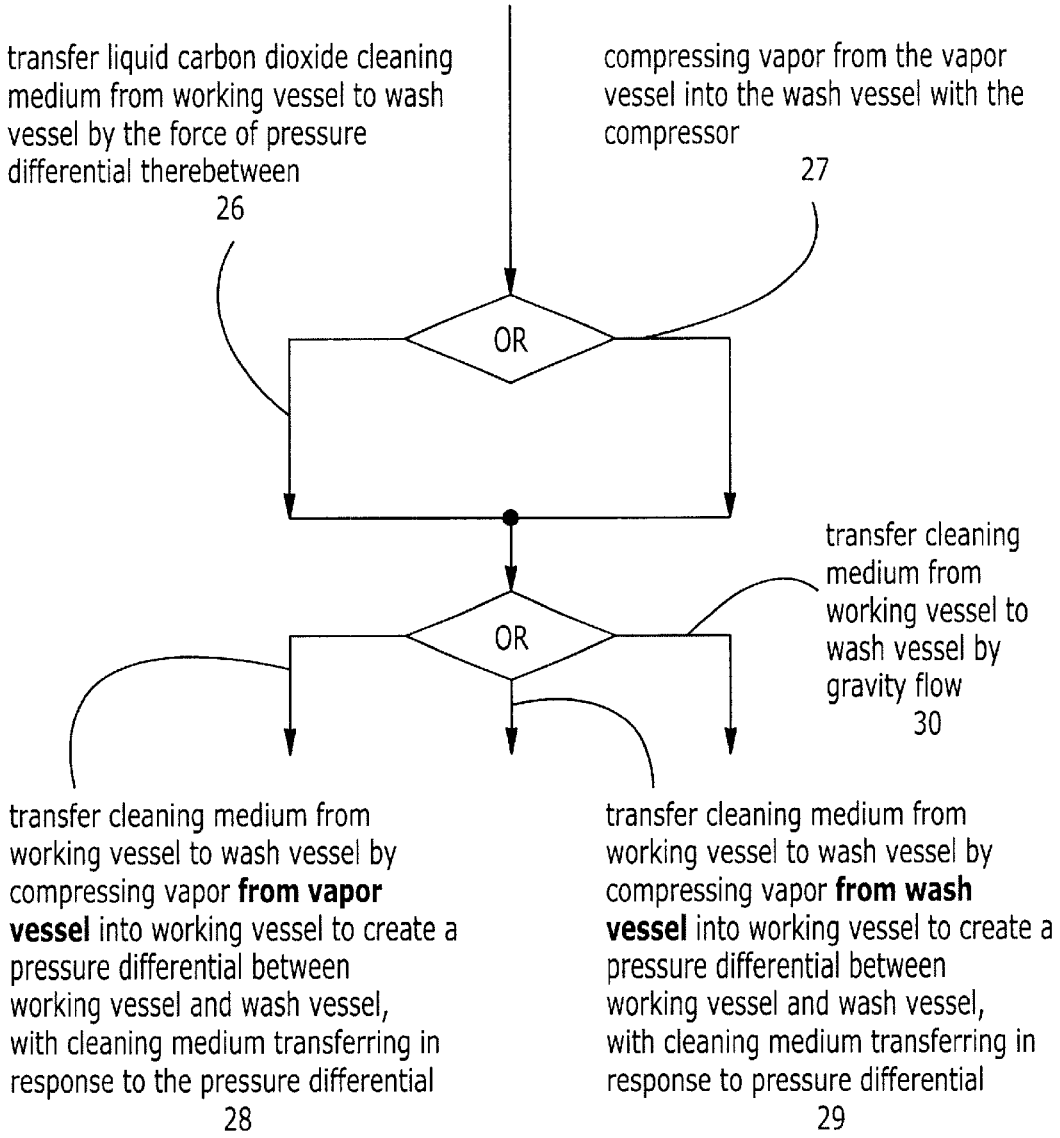
FIG. 2 illustrates alternate methods for the pumpless transfer of carbon dioxide cleaning medium in a carbon dioxide cleaning apparatus.

The pumpless operation of an apparatus of FIG. 1 is schematically illustrated in FIG. 2. In general, liquid carbon dioxide cleaning medium may be transferred 26 from the working vessel to the wash vessel by the force of a pressure differential therebetween. For example, carbon dioxide cleaning medium may flow through line 56, 72 of FIG. 3 toward the wash vessel; that is, it will shoot into the wash vessel, vaporizing at the point of pressure let-down.. This vaporization provides a cooling effect which lowers the pressure conditions required to sustain the cleaning medium as a liquid. Subsequently, at least a portion of the liquid in the working vessel is transferred into the wash vessel; this liquid will be at a lower temperature, which is desirable for the thermodynamic control of the system (preferably cleaning is carried out at a temperature below room temperature, approximately 50 to 60, and preferably 55, degrees F.). At the end of this step the pressure in the wash vessel will be approximately the same as in the working vessel and liquid will substantially cease to flow.

In the alternative, vapor may be compressed 27 from the vapor vessel into the wash vessel with the compressor, preferably until the pressures are approximately equal therein. Following either of these two steps, liquid carbon dioxide may be transferred (or further transferred) by either of three alternative techniques. In a first technique (28) transfer may be carried out by transferring liquid carbon dioxide cleaning medium from the working vessel to the wash vessel by compressing vapor from the vapor vessel into the working vessel to create a pressure differential between the working vessel and the wash vessel, with cleaning medium transferring in response to the pressure differential. In the second alternative (29) transfer may be carried out by transferring liquid carbon dioxide cleaning medium from the working vessel to the wash vessel by compressing vapor from the wash vessel into the working vessel to create a pressure differential between the working vessel and the wash vessel, with cleaning medium transferring in response to the pressure differential. In the third alternative (30) transfer may be carried out by transferring liquid carbon dioxide cleaning medium from the working vessel to the wash vessel using a pressure differential created by difference in elevation or height (e.g., by positioning the working vessel at a greater height than the wash vessel) so that transfer is accomplished by gravity flow. Gravity flow in the third alternative may optionally be augmented by decreasing pressure in the wash vessel during the gravity flow step, such as by opening line 23 of FIG. 1 or line 61 of FIG. 3. In addition or in alternative to augmenting gravity flow by decreasing pressure, the compressor can be used to pull gas from the vapor vessel and push it into the wash tank to enhance flow from the wash tank to the working tank. Reciprocal flow of the cleaning medium may be established by reversing pressure differentials between the wash vessel and the working vessel on one or more, and preferably during a plurality of, occasions during the cleaning cycle, as described above.

Figure 3:
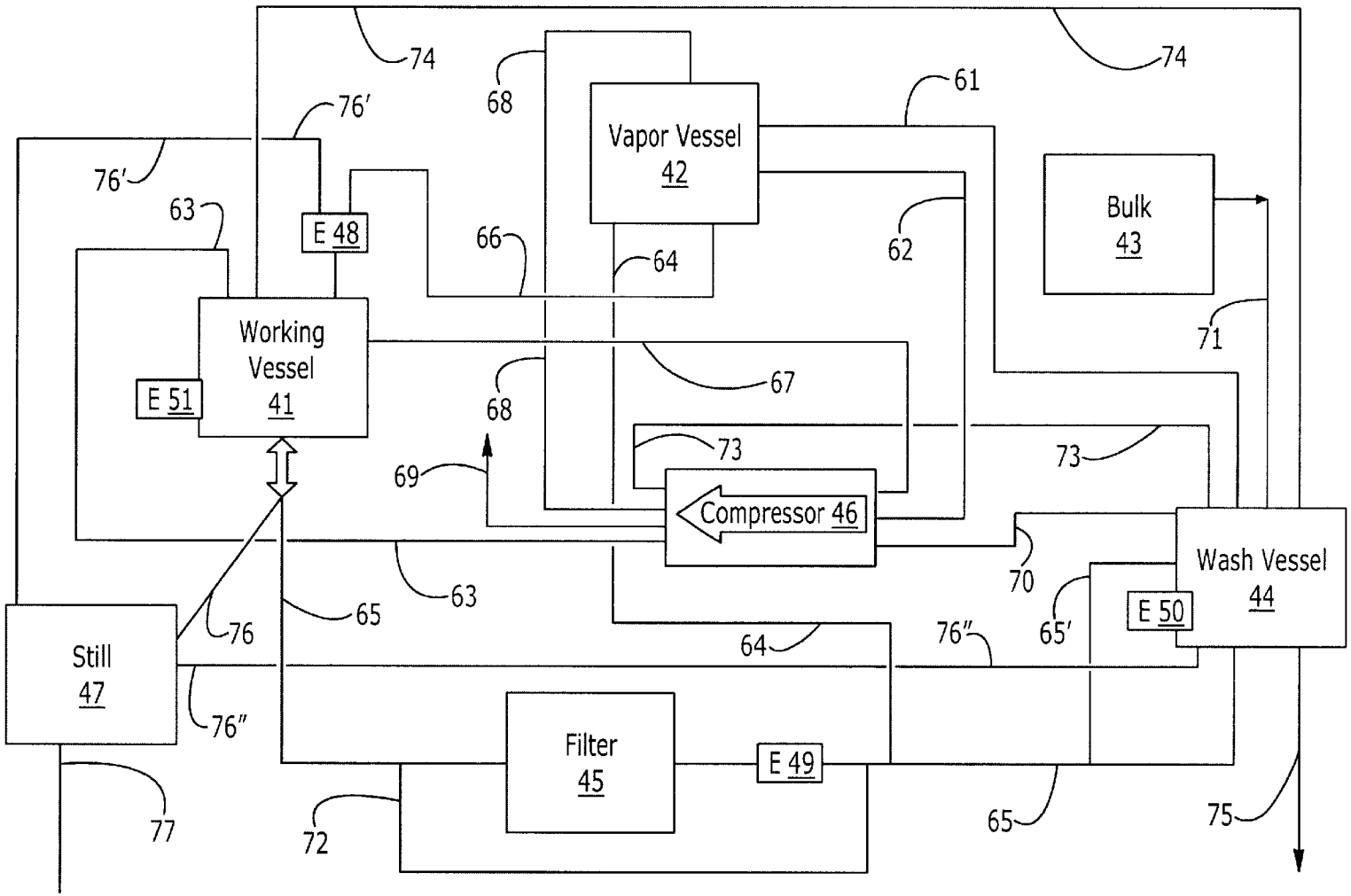
FIG. 3 illustrates one specific embodiment of a dry cleaning apparatus that may be used to carry out the present invention.

A specific embodiment of an apparatus that may be used to carry out the present invention is given in FIG. 3. The operation of the system is predicated in part on the use of between about 10, 30 or 50 to about 130, 150 or 180 psig of overpressurization of a separate overpressurization gas such as air in the system. This overpressurization is caused by air in the vapor (the only place there is substantially pure $CO_2$ gas in the system is coming off of the boiling fluid of distillation).

Overpressurization is useful to avoid a problem that may otherwise occur when using compression of gas to move the liquid. The problem is coupled to the fact that the system (without air) is a single component that, in order to obtain a liquid-gas equilibrium, will exist at the boiling point. Without air, pulling gas out of on chember and pushing it into another, when both chambers contain liquid $CO_2$ at the boiling poing, will cause vigorous boiling (or chilling) in the liquid one is pulling from and condensation (or heating) in the chamber one is pushing into. This problem is overcome herein through the addition of a second component, air, into the gas phase. The air acts as an overpressurization blanket that, when maintained at an effective equilibrium concentration, will allow pulling gas from one chamber and pushing it into another chamber without excessive boiling or condensation. Preferably the system is configured to maintain an equilibrium concentration of air to permit overpressurization at the pressures indicated above, in light of the liquid flow rate between chambers desired. Currently preferred is a system that provides a flow of 50 to 60 gallons per minute (most preferably about 55 gallons per minute) and an overpressurization of 40 to 60 psid (most preferably about 50 psid).

While the overpressurization gas is described herein as air (which is easily obtained) other overpressurization gasses such as nitrogen or helium (including combinations thereof) could also be used.

The apparatus of FIG. 3 comprises a working vessel 41, a vapor vessel 42, a bulk liquid carbon dioxide storage vessel 43, a wash vessel 44, a filter 45, a compressor 46, a still 47, heat exchanger (condenser) 48, heat exchanger 49, heat exchanger 50, and heat exchanger 51 (note that E-51 and still 47 are options that would generally not be used on the same machine). The various components are connected by lines 61–76 and 76', the operation of which is explained in greater detail in the Table below. Line 77 serves as a drain for removing waste from the still 47. Note that valves and controls are not shown, and a dedicated line is shown to illustrate all connections between vessels and other components. Those skilled in the art will appreciate that actual connections may be provided along a common line with appropriate valves and controls as will be appreciated by those skilled in the art.

The wash vessel is preferably provided with a rotating basket or other suitable means for agitating the articles to be cleaned therein during the washing cycle or step. In addition, the wash vessel is preferably operated under liquid part full conditions so that articles being cleaned therein are subjected to a "splash and fall" type of washing, as they are lifted from a liquid phase into a vapor phase and drop back into a liquid phase by rotation of a (preferably horizontal) rotating basket.

The step of circulating liquid dry cleaning medium from the wash vessel to the working vessel and then from the working vessel is preferably repeated, cyclically or in back-and-forth fashion, a plurality of times during the washing step or wash cycle. The number of times the circulating step is repeated during a wash cycle will depend upon the balance of a number of variables and objectives, including the duration of the wash cycle, the volume of the wash vessel, the need to maintain an effective liquid level in the wash vessel; the need to insure effective fluid turn-over through the filter, reasonable valve switching rates, etc. In general, flow will change direction after a period ranging five or ten seconds to one-half to two minutes in duration. Thus, the circulating step may (for example) be cyclically repeated from about 2 or 4 to about 20, 30 or 40 times during a wash cycle. The flow rate in each direction is, in general, from one-quarter, one-third, or one-half gallons per minute to one and one-half or two gallons per minute for each pound of articles to be cleaned contained in the wash vessel (e.g., 30 to 80 gallons per minute for a sixty pound capacity wash vessel, most preferably 50 to 52 gallons per minute for a sixty pound capacity wash vessel), or from one, two, three or four liters per minute to six, eight, twelve or sixteen liters minute for each kilogram of articles to be cleaned contained in the wash vessel).

The operation of an apparatus of FIG. 3 is explained in greater in connection with Table 1 below.

TABLE 1

Steps in Pumpless Operation of Cleaning Apparatus

| Time | Name | Process Steps | Wash Tank psig | Vapor Tank psig | Work Tank psig |
|---|---|---|---|---|---|
| *C* | Initial Conditions | Rest, load clothes, select cycle | 0 | 850 | 750 |
| *C* | Homogenize and Control Temp of liquid | | | | |
| 0 | Equilibrate vapor vessel 42 and working vessel 41 | Open line 66 | 0 | 800 | 800 |
| 0 | Create pressure differential | Open line 62, compressor, line 63 | 0 | 799 | 801 |
| 0 | Circulate liquid through filter and heat-exchanger | Open line 65, filter (F) 45 and E-49, line 64 | 0 | 799 | 801 |
| 0 | Return liquid to working vessel 41 | With compressor 46 still running, open line 68, line 67 and push the liquid back through the line 64, filter or bypass and line 65. | 0 | 800 | 800 |
| | | (OR stop compressor, open line 66, allow to drain by gravity); | (0) | (800) | (800) |
| | | [OR Open line 67, compressor, line 68 and line 66] | [0] | [801] | [799] |
| 1 | Vacuum | Pull vacuum with compressor 46, open line 70, compressor and line 69 | −7 | 800 | 800 |
| 2.5 | Make-up of CO2 | Open line 71 | 80 | 800 | 800 |
| 3 | Partially pressurize wash 44 | Open line 61 | 450 | 450 | 800 |
| | PDPV transfer liquid to wash vessel 44; (OR | Open line 65 and line 72 - avoiding filter during pressure differential partial vaporization (PDPV) transfer. | 600 | 450 | 600–650 (800) |

TABLE 1-continued

Steps in Pumpless Operation of Cleaning Apparatus

| Time | Name | Process Steps | Wash Tank psig | Vapor Tank psig | Work Tank psig |
|---|---|---|---|---|---|
| | Empty vapor 42/Fully pressurize wash vessel 44) | (700)<br>(Open line 62, compressor and line 73) | (150) | | |
| *C* | Transfer liquid from Working 41 to Wash 44 | | | | |
| 5 | Establish gas-side communication | Open line 74 | 750 | 150 | 750 |
| | Drain liquid by gravity; (OR push from vapor vessel 42)<br>[OR Push from Wash 44] | Open line 65, filter 45, E 49<br>(Open line 62, compressor 46, line 63 and open line 65, F-45, E-49)<br>[Open line 70, Compressor, line 63 and open line 65, F-45, E-49] | 750<br>(774)<br>[749] | 150<br>(100)<br>[150] | 750<br>(775)<br>[750] |
| | Wash cycle with circulation | Begin agitation | | | |
| | Circulation from wash 44 to working vessel 41 | Open Line 67, Compressor 46, Line 73 and Open Line 65, F-45, E-49<br>(OR open line 62, compressor 46, line 73, line 65, filter 45 and heat exchanger 49) | 701 | 150 | 699 |
| | Circulation from working vessel 41 to wash vessel 44 | Open Line 70, Compressor, Line 63 and Open Line 65, F-45, E-49;<br>(OR Open Line 74, line 65, F-45, E-49, Allow liquid to return to wash vessel 44 by gravity) | 699 | 150 | 701 |
| | Repeat this circulation for the Duration of the Wash Cycle (Approximately 10 minutes) | | | | |
| 17 | Transfer liquid back to working vessel 41 | Open Line 67, Compressor 46, Line 73 and Open Line 65, F-45, E-49;<br>Spin extract and continue to push residual liquid back to working vessel 41 | 701 | 150 | 699 |
| 19 | Equilibrate wash 44 and vapor vessel 42 | Open line 61 | 500 | 500 | 700 |
| 39 | Vapor Recovery | Open Line 70, Compressor, Line 68 (using methods for vapor recovery); Open E-50 (heater in back of Wash Vessel 44). | 18 | 850 | 700 |
| 40 | Final Vent | Open Line 70, Compressor, Line 69 (AND/OR open line 75) | | | |
| 30-3 | Distillation (I) | Apply heat at E-51 to vaporize liquid in a separate distillation chamber provided within working vessel 41. Apply chill to E-48 (condenser) to condense vapor back into working vessel 41 | | | |
| 30-3 | Distillation (II) | Open Line 76 to drain by gravity 5-25 gallons of liquid into separate still 47; Apply heat to the liquid in the still; Open line 76' to transmit gaseous CO2 to E-48 (condenser) (OR Open line 76 to transmit gaseous CO2 back to working vessel 41: allow gas to bubble through liquid and condense in E-48 (condenser) | | | |

Lines and elements indicated as "open" during various steps in the table above are either closed or maintained open during subsequent step(s) as necessary to achieve the function of the subsequent step(s).

In the table above, pressures are schematic and illustative, and numerous pressures may be employed. For example, 1 psi difference (psid) is used as a schematic to represent a pressure differential created by the compressor to induce flow. In practice the pressure differential will likely be more than this, on the order of 3 or 40 to 60 or 70 psid.

Line 65' may optionally be used to transfer liquid from working vessel 41 to wash vessel 44 during the wash step to allow a liquid entrance into the wash vessel that is not effected by the agitated fluid therein.

Line 76' may be used to draw a portion of fluid (e.g., 5–25 gallons of a pre-wash) from wash vessel 44 to the still 47 for distillation.

The present invention may be implemented in any of a variety of systems or apparatus, including but not limited to the MICARE™ cleaning system and the $MICO_2$ cleaning apparatus, available from Micell Inc. and Hangers Cleaners, Raleigh, N.C. USA (www.micell.com and www.HangersDryCleaners.com), the apparatus described in U.S. Pat. No. 6,098,430 to McClain et al., the apparatus described in U.S. Pat. No. 5,943,721 to Lerett et al., the apparatus described in commonly owned, copending U.S. patent application Ser. No. 09/306,360, filed May 6, 1999; and the apparatus described in commonly owned, copending U.S. patent application Ser. No. 09/405,619, filed Sep. 24, 1999. Applicants specifically intend that the disclosures of all U.S. Patents and Patent Applications cited herein be incorporated by reference herein in their entirety.

Vapor recovery may be carried out in accordance with those techniques described in commonly owned, copending U.S. patent application Ser. No. 09/404,957, filed Sep. 24, 1999.

A separate distillation chamber may be carried out in accordance with those techniques described in commonly owned, copending U.S. Provisional Patent Application Ser. No. 60/240,473, filed Oct. 13, 2000, particularly in connection with FIG. 6 therein.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed is:

1. A method for pumpless transfer of liquid carbon dioxide cleaning medium in a carbon dioxide dry cleaning apparatus having a wash vessel, a working vessel, a vapor vessel, and a compressor, said method comprising the steps of:

(a) storing liquid carbon dioxide dry cleaning medium in said working vessel;

(b) storing a vapor comprising air and carbon dioxide as a gas under pressure in said vapor vessel;

(c) transferring a portion of said vapor from said vapor vessel to said wash vessel, by at least partially equilibrating the pressure between said vapor vessel and said wash vessel, with said wash vessel remaining at a pressure less then that of said working vessel; then (d) transferring at least a portion of said liquid carbon dioxide cleaning medium from said working vessel to said wash vessel by the force of a pressure differential therebetween;

(e) washing articles to be cleaned in said wash vessel while concurrently (f) circulating at least a portion of said liquid dry cleaning medium (i) from said wash vessel to said working vessel by compressing vapor from said working vessel into said wash vessel with said compressor, and then (ii) from said working vessel back to said wash vessel by compressing vapor from said wash vessel into said working vessel with said compressor.

2. A method according to claim 1, said apparatus further having a filter, and wherein said circulating is carried out at least in part through said filter.

3. A method according to claim 1, wherein said step (d) of transferring at least a portion of said liquid carbon dioxide cleaning medium is carried out by providing a difference in elevation between said working vessel and said wash vessel.

4. A method according to claim 1, wherein said step (d) of transferring at least a portion of said liquid carbon dioxide cleaning medium is carried out by:

(i) transferring liquid carbon dioxide cleaning medium from said working vessel to said wash vessel by the force of the pressure differential between said working vessel and said wash vessel; and then (ii) transferring liquid carbon dioxide cleaning medium from said working vessel to said wash vessel by compressing vapor into said working vessel with said compressor to create a pressure differential between said wash working vessel and said wash vessel, with said cleaning medium transferring in response to said pressure differential.

5. A method according to claim 4, wherein said transferring step (ii) is carried out by compressing vapor from said vapor vessel into said working vessel.

6. A method according to claim 4, wherein said transferring step (ii) is carried out by compressing vapor from said wash vessel into said working vessel.

7. A method according to claim 1, wherein said step (d) of transferring at least a portion of said liquid carbon dioxide cleaning medium is carried out by:

(i) compressing vapor from said vapor vessel into said wash vessel with said compressor; and then (ii) transferring liquid carbon dioxide cleaning medium from said working vessel to said wash vessel by compressing vapor into said working vessel with said compressor to create a pressure differential between said wash working vessel and said wash vessel, with said cleaning medium transferring in response to said pressure differential.

8. A method according to claim 7, wherein said transferring step (ii) is carried out by compressing vapor from said vapor vessel into said working vessel.

9. A method according to claim 7, wherein said transferring step (ii) is carried out by compressing vapor from said wash vessel into said working vessel.

10. A method according to claim 1, wherein said transferring step (c) is preceded by at evacuating at least a portion of the air from said wash vessel.

11. A method according to claim 10, said apparatus further having a filter, said method further comprising the step of:

filtering said liquid carbon dioxide cleaning medium through said filter between washing steps and independently of said wash vessel by the force of a pressure differential created with said compressor.

12. A method according to claim 11, said filtering step carried out by transferring said liquid carbon dioxide cleaning medium between said working vessel and said vapor vessel.

13. A method according to claim 12, wherein said filtering step is carried out by (i) transferring said liquid carbon dioxide cleaning medium from said working vessel to said vapor vessel through said filter by the force of a pressure differential created with said compressor, and then (ii) draining said liquid carbon dioxide cleaning medium from said vapor vessel back to said working vessel.

14. A method according to claim 13, wherein said filtering step is carried out by (i) transferring said liquid carbon dioxide cleaning medium from said working vessel to said vapor vessel through said filter by the force of a pressure differential created with said compressor, and then (ii) transferring said liquid carbon dioxide cleaning medium from said vapor vessel back to said working vessel by the force of a pressure differential created with said compressor.

15. A method according to claim 1, wherein said transferring step (c) is preceded by adding carbon dioxide to said wash vessel.

16. A method according to claim 1, wherein said washing step (e) is followed by the steps of:

(f) transferring said liquid carbon dioxide cleaning medium from said wash vessel to said working vessel by the force of a pressure differential created with said compressor; and then (g) transferring said vapor from said wash vessel to said vapor vessel with said compressor.

17. A method according to claim 1, wherein said cleaning apparatus contains an overpressurizing gas.

18. A method according to claim 1, wherein said circulating step (f) is cyclically repeated from 4 to 40 times during said washing step.

19. A method for pumpless transfer of liquid carbon dioxide cleaning medium in a carbon dioxide dry cleaning apparatus having a wash vessel, a working vessel, a vapor vessel, a compressor and a filter, said method comprising the steps of:

(a) storing liquid carbon dioxide dry cleaning medium in said working vessel;

(b) storing a vapor comprising air and carbon dioxide as a gas under pressure in said vapor vessel;

(c) transferring a portion of said vapor from said vapor vessel to said wash vessel, by at least partially equilibrating the pressure between said vapor vessel and said wash vessel, with said wash vessel remaining at a pressure less then that of said working vessel; then (d) transferring at least a portion of said liquid carbon dioxide cleaning medium from said working vessel to said wash vessel by the force of a pressure differential therebetween;

(e) washing articles to be cleaned in said wash vessel while concurrently (f) circulating at least a portion of said liquid dry cleaning medium (i) from said wash vessel to said working vessel by compressing vapor from said working vessel into said wash vessel with said compressor at a flow rate of from one-quarter to two gallons per minute for each pound of articles to be cleaned in said wash vessel, and then (ii) from said working vessel back to said wash vessel by compressing vapor from said wash vessel into said working vessel with said compressor at a flow rate of from one-quarter to two gallons per minute for each pound of articles to be cleaned in said wash vessel; and wherein said circulating is carried out at least in part through said filter; and wherein said cleaning apparatus contains an overpressurizing gas.

20. A method according to claim 19, wherein said circulating step (f) is cyclically repeated from 4 to 40 times during said washing step.

* * * * *

UNITED STATES PATENT AND TRADEMARK OFFICE

CERTIFICATE OF CORRECTION

PATENT NO. : 6,536,059 B2
DATED : March 25, 2003
INVENTOR(S) : McClain et al.

It is certified that error appears in the above-identified patent and that said Letters Patent is hereby corrected as shown below:

Column 10,
Line 8, please correct "claim 13" to read -- claim 12 --

Signed and Sealed this

Seventh Day of October, 2003

JAMES E. ROGAN
*Director of the United States Patent and Trademark Office*